US007057084B2

(12) United States Patent
Nielsen et al.

(10) Patent No.: US 7,057,084 B2
(45) Date of Patent: Jun. 6, 2006

(54) PROCESS FOR THE REMOVAL OF HIGHER HYDROCARBONS FROM NATURAL GAS

(75) Inventors: Poul Erik Høilund Nielsen, Fredensburg (DK); Niels Jørgen Blom, Hillerød (DK)

(73) Assignee: Haldor Topsoe A/S, Lyngby (DK)

( * ) Notice: Subject to any disclaimer, the term of this patent is extended or adjusted under 35 U.S.C. 154(b) by 568 days.

(21) Appl. No.: 10/265,394

(22) Filed: Oct. 7, 2002

(65) Prior Publication Data

US 2003/0118496 A1 Jun. 26, 2003

(30) Foreign Application Priority Data

Oct. 10, 2001 (DK) ..... PA 2001 01492
Nov. 3, 2001 (DK) ..... PA 2001 01633

(51) Int. Cl.
*C07C 2/76* (2006.01)

(52) U.S. Cl. ..... 585/943; 585/418

(58) Field of Classification Search ..... 585/943, 585/418

See application file for complete search history.

(56) References Cited

U.S. PATENT DOCUMENTS 3,827,867 A * 8/1974 Heinemann et al. ..... 585/310
4,260,839 A 4/1981 Chen et al.
4,350,835 A 9/1982 Chester et al.
4,720,602 A 1/1988 Chu
5,151,259 A 9/1992 Blom
5,436,380 A 7/1995 Sawa et al.

FOREIGN PATENT DOCUMENTS

EP 0323 132 7/1989

* cited by examiner

*Primary Examiner*—Thuan D Dang
(74) *Attorney, Agent, or Firm*—Dickstein Shapiro Morin & Oshinsky LLP

(57) ABSTRACT

Process for the removal of higher hydrocarbons contained in natural gas further containing sulphur compounds by simultaneous conversion of the hydrocarbons to aromatic compounds and methane in presence of a catalyst comprising a crystalline alumino silicate having in its anhydrous state a formula expressed in terms of mole ratios as follows:

$$xQ:0.01\text{–}0.1\ M_{2/n}O:0\text{–}0.08\ Z_2O_3:SiO_2:0.0001\text{–}0.5\ Me,$$

wherein:
Q is an organic nitrogen compound;
Z is aluminum, boron, gallium or mixtures thereof;
x is between 0 and 0.5;
M is at least one metal cation of valence n or proton; and
Me is at least one of the metals, which form a water insoluble sulphide by contact with a sulphur compound being present in the natural gas and/or in a preparation mixture for preparation of the catalyst.

5 Claims, No Drawings

PROCESS FOR THE REMOVAL OF HIGHER HYDROCARBONS FROM NATURAL GAS

The present invention is directed to treatment of natural gas and in particular to a process for the removal of higher hydrocarbons from natural gas.

Natural gas contains methane as major component. Depending on the particular source, natural gas further contains cyclic saturated hydrocarbons up to C5 and varying amounts of gaseous impurities such as nitrogen, carbon dioxide and sulphur compounds usually in form of hydrogen sulphide.

To adjust natural gas to required quality standards low boiling substances and water have to be removed to meet pipeline dew point specifications. The desired Wobbe index and calorific value furthermore require a reduction in the concentration of higher hydrocarbons.

Removal or reduction of the content of higher hydrocarbons is conventionally accomplished by condensation at low temperature.

It is further known to recover those hydrocarbons by catalytic conversion to LPG, gasoline or aromatic compounds.

Aromatisation of hydrocarbons is an endothermic reaction and it has been proposed to carry out exothermic hydrocracking and endothermic aromatic synthesis simultaneously in a catalytic reaction zone according to the following reaction when taking propane as an example of the higher hydrocarbons to be removed from natural gas:

9 C3H8=2 C6H6+15 CH4

The reaction is substantially thermo-neutral with an enthalpy of −5 kcal/mole.

The above simultaneous endo and exothermic reaction have been applied and mentioned in U.S. Pat. No. 4,260,839 for ethane conversion in production of LPG, gasoline and aromatics by contact with a ZSM-5 type catalyst.

The combination of endothermic reactions with exothermic reactions in conversion of LPG to aromatic compounds in presence of gallium or zinc and a crystalline zeolite is furthermore known from U.S. Pat. Nos. 4,350,835 and 4,720,602.

A process for aromatisation of a gas comprising hydrocarbons from hexane to $C_{12}$ and sulphur compounds is disclosed in the European Patent Application No. 0 323 132. The process is catalysed by a zeolite of ZSM-5 type, which converts the paraffinic hydrocarbons to aromatic compounds and suppresses hydrogenolysis at 1000° F. (538°).

Another zeolite catalyst, however, including a metal sulphide is described in the European Patent No. EP 0 434 052, and this catalyst is used for conversion of propane, butane or hexane into aromatic compounds and maximum 20% methane and ethane at 500–570° C. This reaction is purely endothermic.

Prior art, however, fails to disclose processing of natural gas containing sulphur compounds as it is usually recovered from many sources. The composition of natural gas expressed as molar percentage is typically 75–99% methane, 1–15% ethane, 1–10% propane, 0–2% n-butane, 0–1% isobutane, 0–1% n-pentane, 0–1% isopentane, 0–1% hexane and 0–0.1% heptane plus higher hydrocarbons. As mentioned above typical natural gas sources deliver the gas with a content of between a few ppm to about 1000 ppm sulphur compounds. Sulphur in feed gas is by the known aromatisation processes conventionally removed from the gas prior to treatment.

However, no prior art discloses the simultaneous exothermic hydrocracking of the higher components of a natural gas and endothermic synthesis of aromatic compounds from the higher components of the natural gas, which form a thermo-neutral process. Still, "higher components" are as low as propane. The process converts a sulphur containing natural gas to an enriched gas with a high content of methane, some ethane and aromatic compounds and a very low content of higher hydrocarbons at above 600° C. The product is easily separated in the enriched gas and the aromatic compounds by simple condensation and phase separation.

It is, thus, the general object of the invention to improve the known methods and processes for conversion of lower hydrocarbons, i.e. the higher hydrocarbons of a natural gas to valuable aromatic compounds in presence of sulphur compounds.

In compliance with the above object it has been found that metal sulphide modified crystalline aluminosilicate zeolites provide high selectivity in the conversion of lower hydrocarbons to aromatic compounds and improved operation time when applied as catalysts in a feed gas of sulphur containing natural gas. As further an advantage, the metal sulphide modified zeolitic catalysts promote exothermic hydrocracking of the lower hydrocarbons to methane simultaneously with the aromatisation reaction, so that a substantially thermo-neutral reaction according to the above reaction scheme is obtained.

Accordingly, the present invention is a process for the removal of higher hydrocarbons contained in natural gas further containing sulphur compounds by simultaneous conversion of the hydrocarbons to aromatic compounds and methane in presence of a catalyst comprising a crystalline alumino-silicate having in its anhydrous state a formula expressed in terms of mole ratios as follows:

$$xQ:0.01\text{–}0.1\ M_{2/n}O:0\text{–}0.08\ Z_2O_3:SiO_2:0.0001\text{–}0.5\ Me,$$

wherein:

Q is an organic nitrogen compound;

Z is aluminum, boron, gallium or mixtures thereof;

x is between 0 and 0.5;

M is at least one metal cation of valence n or proton; and

Me is at least one of the metals, which form a water insoluble sulphide compound by contact with a sulphur compound being present in the natural gas and/or in a preparation mixture for preparation of the catalyst.

It will be apparent from the following detailed description that the catalysts according to the invention catalyze conversion of higher hydrocarbons with high selectivity to aromatic compounds in natural gas feed stock with a content of between few ppm and more than 1000 ppm sulphur compounds as being typical in natural gas from different sources. As further an advantage of the invention, natural gas can be treated at thermo-neutral conditions and at a pressure as typically prevailing in gas distribution pipelines.

In order to maintain the catalyst in its sulphidised form, it is furthermore preferred to adjust the content of sulphur compounds in the treat gas to a concentration of at least 0.5 ppm by volume.

When carrying out the inventive process at large applications, the preferred crystalline aluminosilicate are conventionally zeolites of the ZSM-5 types in its hydrogen form. The preferred metal are Zn and/or Cu as the metal forming sulphides.

EXAMPLES

Example 1

A reaction mixture was prepared by the following procedure:

(a) A solution of 26.3 g $Na_2S \cdot 9H_2O$ in 100 g of hot water was slowly added with stirring to 22.4 g $Zn(CH_3COO)_2 \cdot 2H_2O$ in 800 g of hot water, and maintained at 80° C. for 2 hours. The mixture was allowed to stand at room temperature for about 3 days before the solid metal sulphide product was separated from the liquor by filtration.

(b) 19.8 g $Al_2(SO_4)_3 \cdot 18H_2O$ and 71.1 g tetrapropylammonium bromide (TPABr) were dissolved in 297 g of $H_2O$ and mixed with 47.7 g conc. $H_2SO_4$.

(c) 570.0 g sodium silicate (27.8 wt % $SiO_2$, 8.2 wt % $Na_2O$, 64 wt % $H_2O$) in 329.5 g of $H_2O$.

(d) 82.8 g NaCl was dissolved in 270 g of $H_2O$ and solution (b) and (c) were added simultaneously under vigorous mixing.

(e) The resultant gel (d) was mixed with (a) until a homogeneous phase appeared.

The reaction mixture was crystallized at autogenous pressure at static conditions at 140° C. for 92 hours. A solid crystalline product was separated by filtration, washed with water and dried at 130° C. for 16 hours.

Chemical analyses of a sample of this product gave the following composition, $SiO_2/Al_2O_3$=70 (mole), 3.0 wt % Zn and 1.35 wt % S.

The XRD contained the lines of zeolite ZSM-5.

Examples 2

The crystalline product prepared in Example 1 was activated by calcination in air at 550° C. for 4 hours and further activated by ion-exchange three times using 10 ml of 2 M acetic acid solution per g product for 1 hour in each ion-exchange step, washed with water, dried at 120° C. for 16 hours and finally calcined in air at 550° C. for 6 hours.

The resulting hydrogen form of the product was tested for its catalytic activity in the conversion of hydrocarbons to aromatics and methane. Two tests with different on stream times were performed.

Example 3

Test of the above metal sulphide modified aluminosilicates.

The aromatization reaction was carried out by loading 1 g of the catalyst in a quartz reactor tube and passing through the desired hydrocarbon(s) to be converted at atmospheric pressure.

After the desired times on stream the total effluent was analyzed by on line gas chromatography. The hydrocarbon distribution (wt %) was calculated by disregarding the composition of the feed.

The temperature, flow rates and the results of the aromatization reaction are shown in Table 1, which follows.

The terms used in Table 1 and in the following Tables are defined as follows:

| | |
|---|---|
| Selectivity | = (Hydrocarbons converted to a specific product × 100)/–Hydrocarbon consumed. |
| Yield | = (Selectivity to the specific product × conversion) /100. |

Examples 4

An aluminosilicate, as prepared in Example 1 but without addition of the metal sulphide, was activated as described in Example 2.

The resulting hydrogen form (H-ZSM-5; $SiO_2/AlO_3$=72) was mixed with ZnS (supplied by Aldrich) and calcined in air at 550° C. for 6 hours. The final catalyst containing about 3 wt % of admixed Zn was tested for aromatization activity as described in Example 2. The process conditions used and the results obtained are given in the Table 1.

Test of comparative catalysts.

Example 5

The hydrogen form of the ZSM-5 was mixed with ZnO (supplied by Aldrich) and calcined in air at 550° C. for 6 hours to a final content of about 3 wt % of added Zn. This catalyst was tested for aromatization activity as described in Example 3. The process conditions used and the results obtained are given in Table 1.

Example 6

Five g of the hydrogen form of ZSM-5 and 0.55 g zinc acetate dihydrate were mixed with 10 g of water. The mixture was evaporated to dryness and the residue was calcined in air at 550° C. for 6 hours. The final catalyst containing about 3 wt % of added Zn was tested for aromatization activity as described in Example 3. The process conditions used and the results obtained are given in Table 1.

Example 7

A ZnO containing crystalline aluminosilicate was prepared in a similar procedure to that of Example 1 with the exception that no metal sulphide, but ZnO was added to the reaction mixture. The ZnO containing reaction mixture was autoclaved as described in Example 1. The resulting catalyst was activated as described in Example 2. The final catalyst containing about 3 wt % of added Zn was tested for aromatisation activity as described in Example 3. The process conditions and the results of the aromatisation reactions are shown in Table 1.

The results of Examples 2 and 4 set forth in Table 1 below show that the catalyst of this invention provide a higher selectivity for the production of aromatics compared to comparative catalysts 5–7, when used in the conversion of isobutane to aromatics.

TABLE 1

| | Example | | | | | |
|---|---|---|---|---|---|---|
| | 2 | 3 | 4 | 5 | 6 | 7 |
| Zn wt % | 3 | 3 | 3 | 3 | 3 | 3 |
| Temp. ° C. | 502 | 502 | 502 | 502 | 502 | 502 |
| On stream time, Hr | 3 | 5 | 2 | 3 | 4 | 2 |
| Feed | i-C4H10 | i-C4H10 | i-C4H10 | i-C4H10 | i-C4H10 | i-C4H10 |
| WHSV §) | 1.66 | 1.66 | 1.66 | 1.66 | 1.66 | 1.66 |
| Conversion wt % | 96.07 | 96.33 | 99.05 | 99.92 | 99.63 | 99.84 |
| Hydrocarbon-Distribution wt % | | | | | | |
| Methane | 9.57 | 10.62 | 11.44 | 15.72 | 16.38 | 16.87 |
| Ethylene | 2.99 | 2.84 | 0.95 | 0.42 | 0.50 | 0.37 |
| Ethane | 4.60 | 4.73 | 10.65 | 19.56 | 17.40 | 16.13 |
| Propylene | 3.78 | 3.57 | 2.21 | 0.76 | 1.30 | .85 |
| Propane | 10.60 | 10.08 | 10.86 | 6.80 | 9.64 | 9.21 |
| Butanes | 0.69 | 0.67 | 0.42 | 0.06 | 0.19 | 0.07 |
| Butenes | 4.20 | 4.03 | 3.62 | 0.46 | 1.52 | 0.74 |
| C5+ PON *) | 0.64 | 0.63 | 0.12 | 0.00 | 0.02 | 0.00 |
| Benzene | 14.80 | 14.98 | 16.73 | 15.40 | 13.82 | 16.73 |
| Toluene | 28.03 | 27.90 | 27.27 | 23.43 | 22.83 | 25.26 |
| Xylenes | 14.80 | 14.92 | 13.18 | 13.05 | 12.47 | 11.65 |
| C9+ Ar. **) | 5.29 | 5.03 | 2.57 | 4.35 | 3.94 | 2.12 |
| Produkt Selectivity, % | | | | | | |
| Aromatics | 62.92 | 62.83 | 59.75 | 56.23 | 53.06 | 55.76 |
| CH4 + C2H6 | 14.17 | 15.35 | 22.09 | 35.28 | 33.78 | 33.00 |
| Aromatic yields | 60.45 | 60.52 | 59.18 | 56.19 | 52.86 | 55.67 |

*) C5+ paraffins, olefins and naftenes.
**) C9 aromatics and higher aromatics.
§) Space velocity: g feed/g catalyst · hours.

Examples 8–9

The catalysts employed in the Examples were prepared from a reaction mixture by the following procedure:

(a) A solution of 41.08 g $Na_2S \cdot 9H_2O$ in 100 g of hot water was slowly added with stirring to 20.4 g $Zn(CH_3COO)_2 \cdot 2H_2O$ and 17.14 g $Cu(NO_3)2.3H_2O$ in 900 g of hot water, and maintained at 80° C. for 2 hours. The mixture was allowed to stand at room temperature for about 3 days before the solid metal sulphide product was separated from the liquor by filtration.

(b) 19.8 g $Al_2(SO_4)_3 \cdot 18H_2O$ and 71.1 g tetrapropylammonium bromide (TPABr) were dissolved in 297 g of $H_2O$ and mixed with 47.7 g conc. $H_2SO_4$.

(c) 570.0 g sodium silicate (27.8 wt % $SiO_2$, 8.2 wt % $Na_2O$, 64 wt % $H_2O$) in 329.5 g of $H_2O$.

(d) 82.8 g NaCl was dissolved in 270 g of $H_2O$ and solution (b) and (c) were added simultaneously under vigorous mixing (in Example 12, 105.0 g KCl were used instead of 82.8 g NaCl).

(e) The resultant gel (d) was mixed with (a) until a homogeneous phase appeared.

The reaction mixture was crystallized at autogenous pressure at static conditions at 140° C. for 92 hours. A solid crystalline product was separated by filtration, washed with water and dried at 130° C. for 16 hours.

Chemical analyses of a sample of this product gave the following composition, $SiO_2/Al_2O_3$=81 (mole), 2.6 wt % Zn, 2.0 wt % Cu and 2.1 wt % S.

The XRD contained the lines of zeolite ZSM-5.

The catalyst was finally activated as in Example 2.

Before use the zeolite was imbedded in a matric consisting of pure silica by mixing the zeolite with colloid silica (LUDOX AS 40—supplied by de Pont) to obtain a 65 wt % zeolite content.

The catalyst obtained was calcined in air at 500° C. for two hours.

The catalyst was tested in a stainless steel reactor (i.d. 8 mm).

The test in Example 8 was carried out with pure propane, and after the test the catalyst was regenerated by calcination in air at 525° C. for 4 hours.

The test in Example 9 was carried out with propane feed gas containing diethylsulphide.

Process conditions and results obtained thereby are summarised in Table 2 below.

The pressure was 3.2 bar and temperature 525° C. in all tests.

TABLE 2

| | Example | | | | |
|---|---|---|---|---|---|
| | 8 | | | 9 | |
| Run Hours | 12 | 96 | 146 | 168 | 197 |
| Feed Gas | | Pure Propane | | Propane 45 ppm diethylsulphide | |
| WHSV | 1.26 | 1.21 | 1.17 | 1.18 | 1.31 |
| Conversion % ($C_1$ %) | | 43.96 | 31.42 | 22.64 | 37.20 |
| $CH_4$ | 11.19 | 9.33 | 7.87 | 8.72 | 8.14 |
| $C_2$ | 19.20 | 15.03 | 13.98 | 12.97 | 14.89 |
| $C_2$+ | 5.86 | 9.74 | 12.91 | 8.76 | 10.27 |
| Aromatic | | 63.75 | 65.90 | 65.24 | 69.55 |
| SUM | 100 | 100 | 100 | 100 | 100 |
| Selectivity for Ar in $C_{2+}$ % | 71.78 | 72.08 | 70.81 | 76.19 | 76.61 |

As apparent from the above results, selectivity of the catalyst towards formation of aromatic compounds (Ar) increases by presence of sulphur in the feed gas.

Examples 10–12

Treatment of natural gas containing 1010 ppm $H_2S$.

Example 10

The catalyst employed was prepared by impregnation of H-ZSM-5 with a solution of Zn acetate and calcined in air at 525° C. for 4 hours. The final catalyst contained 3.21 wt % Zn.

Example 11

The catalyst employed was the same as used in Example 10 with the exception that the catalyst was presulphidised in process gas for 2 hours at 350° C.

Example 12

The catalyst was prepared from a reaction mixture by the following procedure:

(a) A solution of 17.55 g $Na_2S \cdot 9H_2O$ in 100 g of hot water was slowly added with stirring to 8.54 g $Zn(CH_3COO)_2 \cdot 2H_2O$ and 7.47 $Cu(NO_3)_2.3H_2O$ in 900 g of hot water, and maintained at 80° C. for 2 hours. The mixture was allowed to stand at room temperature for about 3 days before the solid metal sulphide product was separated from the liquor by filtration.

(b) 19.8 g $Al_2(SO_4)_3 \cdot 18H_2O$ and 71.1 g tetrapropylammonium bromide (TPABr) were dissolved in 297 g of $H_2O$ and mixed with 47.7 g conc. $H_2SO_4$.

(c) 570.0 g sodium silicate (27.8 wt % $SiO_2$, 8.2 wt % $Na_2O$, 64 wt % $H_2O$) in 329.5 g of $H_2O$.

(d) 82.8 g NaCl was dissolved in 270 g of $H_2O$ and solution (b) and (c) were added simultaneously under vigorous mixing.

(e) The resultant gel (d) was mixed with (a) until a homogeneous phase appeared.

The reaction mixture was crystallized at autogeneous pressure in a static autoclave at 140° C. for about 92 hours. A solid crystalline product was separated by filtration, washed with water and dried at 130° C. for 16 hours.

Chemical analysis of a sample of this product gave the following compositions, $SiO_2/Al_2O_3$=72 (mole), 1.32 wt % Zn, 0.98 wt % Cu and 1.05 wt % S.

The XRD contained the lines of zeolite ZSM-5.

The catalyst was finally activated as in Example 2.

In Examples 10–12 the catalysts were tested with natural gas as feed stock containing 1010 ppm $H_2S$ and having a composition of $CH_4$ 61.15%, $C_2$ 18.27%, $C_3$ 11.69% and $C_{4+}$ 8.89%. In every test, 1 g of the catalyst was loaded in a quartz reactor tube. Reaction conditions and results are summarised in Table 3 below.

TABLE 3

| | Process condition: | | |
|---|---|---|---|
| | Example | | |
| | 10 | 11 | 12 |
| Run Hours | 4 | 5 | 2 |
| Pressure | atm | atm | atm |

TABLE 3-continued

| | Process condition: | | |
|---|---|---|---|
| | Example | | |
| | 10 | 11 | 12 |
| Temperature ° C. | 600 | 600 | 600 |
| GHSV NG | 1000 | 1000 | 1000 |
| Conversion % ($C_1$ %) | 30.91 | 36.39 | 45.67 |
| $CH_4$ | 65.12 | 65.59 | 67.11 |
| $C_2$ | 21.50 | 21.13 | 20.03 |
| $C_3$ | 4.78 | 3.34 | 1.12 |
| $C_4$+ | 0.50 | 0.3 | 0.11 |
| Aromatic | 8.10 | 9.64 | 11.63 |
| SUM | 100 | 100 | 100 |
| Selectivity to Ar in $C_2$+ % | 23.22 | 28.02 | 35.36 |

The results in Example 11 and 12 in Table 3 show that the presulphidased results in an increase in both conversion and selectivity to aromatics and methane.

Example 13

The catalyst prepared in Example 1 was applied in fluid bed manner for treatment of natural gas containing 2 ppm $H_2S$ at 1 atm pressure and a temperature of 625° C. Two different tests were carried out, Test 1 at a space velocity of 2000 h-1 and Test 2 at a space velocity of 4000h-1.

The tests were operated in cycles with the following steps:

1 hour with 4% oxygen in $N_2$ with a starting temperature of 450° C. increasing to operation temperature of 625° C. The pure $N_2$ at 625° C. for 0.5 hour and reaction with natural gas was performed for 2 hours at 625° C. and finally 0.5 to 1 hour with $N_2$ until temperature of the catalyst bed had decreased from 625° C. to 450° C. at conditions as in the first cycle.

The cycles were repeated 24 times.

The results obtained in the last operation cycle are summarised in the Table below.

TABLE 4

| | Feed | Test 1 Exit Gas | Test 2 Exit Gas |
|---|---|---|---|
| % $CH_4$ | 93.3 | 95.35 | 94.60 |
| % $C_2H_6$ | 4.8 | 2.20 | 1.14 |
| % $C_3H_8$ | 1.1 | 0.01 | 0.15 |
| % $C_4H_{10}$ | 0.4 | 0 | 0 |
| % $C_5$+ | 0.4 | 0 | 0 |
| % $C_6H_6$ | — | 0.48 | 0.38 |
| % $C_7H_{10}$ | — | 0.32 | 0.32 |
| % $C_8H_{10}$ | — | 0.02 | 0.03 |

Example 14

Natural gas with a content of 5 ppm THT was treated at a pressure of 38 bar as typical in transfer pipelines.

The catalyst was prepared as in Example 1 and activated as in Example 2.

The ZnS-zeolite was impregnated with a solution of $Ga(NO3)_3$ 9 $H_2O$ after incipient wetness method, dried at 120° C. and calcined at 525° C. for 4 hours in air, resulting in a ZnS-zeolite containing 0.95 wt % Ga. The zeolite was imbedded in $SiO_2$ as in Examples 8–9.

Process conditions and results are summarised in Table 5.

TABLE 5

| Process condition: | | |
|---|---|---|
| Run Hours | | 5 |
| Pressure, bar | | 38 |
| Temperature ° C. | | 670 |
| GHSV NG | | 1000 |
| Conversion % ($C_1$ %) | | 89.3 |
| Composition | Feed | Product |
| $CH_4$ | 72.94 | 94.87 |
| $C_2H_6$ | 16.82 | 2.82 |
| $C_3H_8$ | 6.19 | 0.04 |
| $C_4$+ | 4.05 | 0.04 |
| Aromatic | — | 2.23 |
| SUM | 100 | 100 |
| Selectivity to-benzene | | 76.2% |

As apparent from the above result, simultaneous conversion of lower hydrocarbons in natural gas to methane and aromatic is obtained.

The invention claimed is:

1. A method of using a crystalline alumino silicate as a catalyst for removal of higher hydrocarbons from natural gas by simultaneous conversion of the hydrocarbons in the natural gas to aromatic compounds and methane, wherein the natural gas contains sulphur compounds, and wherein the crystalline alumino silicate has, in its anhydrous state, a formula expressed in terms of mole ratios as follows:

$$xQ: 0.01–0.1M_{2/n}O:0–0.08Z_2O_3.SiO_2:0.0001–0.5 Me,$$

wherein Q is an organic nitrogen compound,

Z is aluminum, boron, gallium or mixtures thereof, x is between 0 and 0.5,

M is at least one metal cation of valence n or proton, and

Me is at least one of the metals, which form a water insoluble sulphide by contact with a sulphur compound being present in the natural gas and/or in a preparation mixture for preparation of the alumino silicate.

2. The method of claim 1, wherein Me is Zn and/or Cu.

3. The method of claim 1, wherein the crystalline alumino silicate is a H-ZSM-5 zeolite.

4. The method of claim 1, wherein content of the sulphur compounds is maintained in a concentration of at least 0.1 ppm by volume.

5. The method of claim 1, wherein the conversion is performed at a temperature of above 600° C.

* * * * *